US011105084B1

(12) United States Patent
Cui et al.

(10) Patent No.: US 11,105,084 B1
(45) Date of Patent: Aug. 31, 2021

(54) DRY CONNECTION PREFABRICATED ASSEMBLY STEEL-CONCRETE COMPOSITE BEAM

(71) Applicants: Bing Cui, Beijing (CN); Canhui Zhao, Sichuan (CN); Zhengyu Liu, Anhui (CN)

(72) Inventors: Bing Cui, Beijing (CN); Canhui Zhao, Sichuan (CN); Zhengyu Liu, Anhui (CN)

( * ) Notice: Subject to any disclaimer, the term of this patent is extended or adjusted under 35 U.S.C. 154(b) by 59 days.

(21) Appl. No.: 16/228,988

(22) PCT Filed: Jul. 24, 2017

(86) PCT No.: PCT/CN2017/113886
§ 371 (c)(1),
(2) Date: Jun. 8, 2019

(87) PCT Pub. No.: WO2018/196376
PCT Pub. Date: Nov. 1, 2018

(30) Foreign Application Priority Data

Jul. 24, 2017 (CN) ..... 201710607086.8

(51) Int. Cl.
*E04B 1/04* (2006.01)
*E04B 1/14* (2006.01)
*E04B 1/24* (2006.01)

(52) U.S. Cl.
CPC ..... *E04B 1/043* (2013.01); *E04B 1/14* (2013.01); *E04B 1/2403* (2013.01); (Continued)

(58) Field of Classification Search
CPC ..... E04B 1/043; E04B 1/14; E04B 1/2403; E04B 2001/2415; E04B 2001/2418; E04B 2001/2442; E04C 3/293
See application file for complete search history.

(56) References Cited

U.S. PATENT DOCUMENTS 5,682,635 A * 11/1997 Tolliver ..... E01D 19/125 14/14
2006/0230706 A1* 10/2006 Skendzic ..... E04C 2/044 52/794.1

(Continued)

FOREIGN PATENT DOCUMENTS

CN 106481023 3/1917
CN 107227821 10/1917

(Continued)

*Primary Examiner* — Beth A Stephan
(74) *Attorney, Agent, or Firm* — Law Offices of Steven W. Weinrieb

(57) ABSTRACT

A dry connection prefabricated assembly steel-concrete composite beam, comprising a steel beam (400), a concrete slab (300) composed of steel bars (301) and concrete, a steel plate connector (100) composed of a steel plate (101), shear connection pieces (102) and connection rods (103), and a pair of inter-plate connection pieces respectively composed of an upper connection plate (501), a lower connection plate (502), a horizontal connection plate (503), a triangular reinforcing steel plate (504) and first and second shear connection pieces (505, 507). An upper surface of each horizontal connection plate (503) is vertically connected to the upper connection plate (501) and the first shear connection pieces (505), a lower surface is vertically connected to the lower connection plate (502), the triangular reinforcing steel plate (504) is welded between a lower surface of the horizontal connection plate (503) and a side surface of the lower connection plate, and one side surface of the upper connection plate (501) is horizontally connected to the second shear connection pieces (507). Both ends of the steel bars (301), which are laterally preset within the concrete slab (300), are provided with screw threads, and the screw thread ends of the steel bars respectively pass through bolt holes (509) and work holes (5010) arranged at upper ends of the upper connection plates (501) to be fixedly connected via (Continued)

screw nuts (302). The composite beam reduces on-site workload, and facilitates disassembly.

7 Claims, 5 Drawing Sheets

(52) U.S. Cl.
CPC ..... *E04B 2001/2415* (2013.01); *E04B 2001/2418* (2013.01); *E04B 2001/2442* (2013.01)

(56) References Cited

U.S. PATENT DOCUMENTS

| | | | | |
|---|---|---|---|---|
| 2008/0072511 | A1* | 3/2008 | Phuly | E02D 27/26 52/294 |
| 2008/0282644 | A1* | 11/2008 | Hong | E04C 3/293 52/847 |
| 2011/0225927 | A1* | 9/2011 | Kim | E04C 3/293 52/835 |
| 2011/0265422 | A1* | 11/2011 | Kim | E04C 3/291 52/745.21 |
| 2019/0084183 | A1* | 3/2019 | Phuly | E02D 27/08 |

FOREIGN PATENT DOCUMENTS

| | | |
|---|---|---|
| CN | 1721636 | 1/2006 |
| CN | 204199537 | 3/2015 |
| JP | 2007-211507 | 8/2007 |
| KR | 10-2006-0068694 | 6/2006 |

* cited by examiner

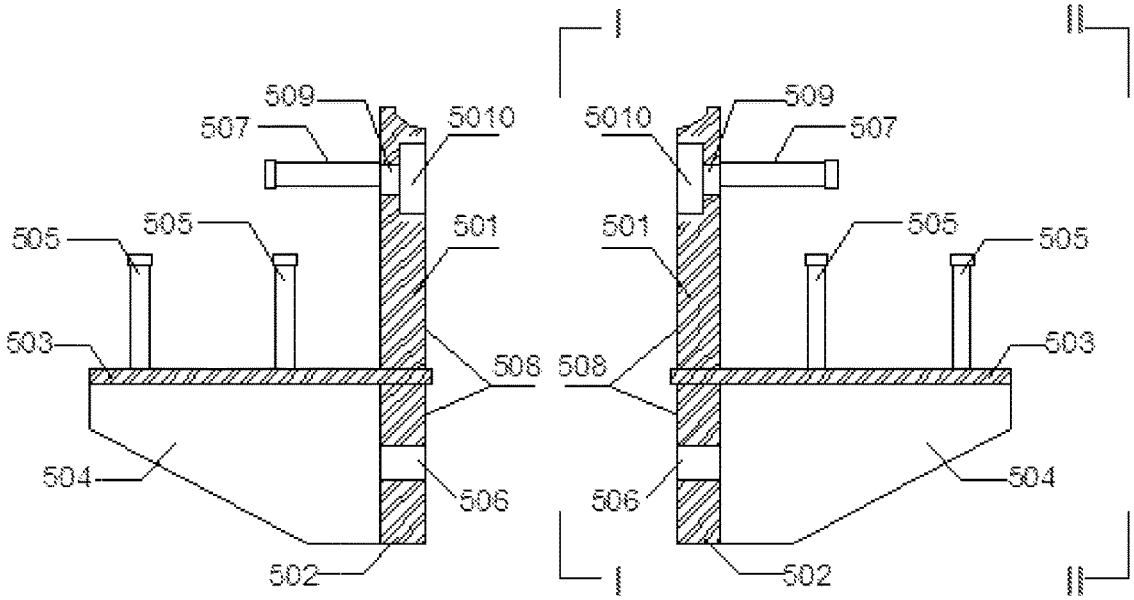
FIGURE 3
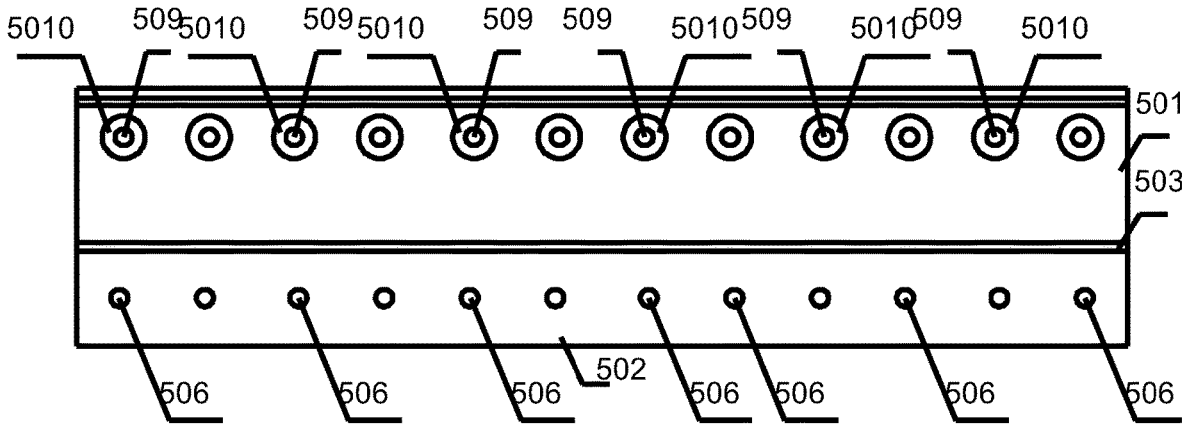
FIGURE 3-A
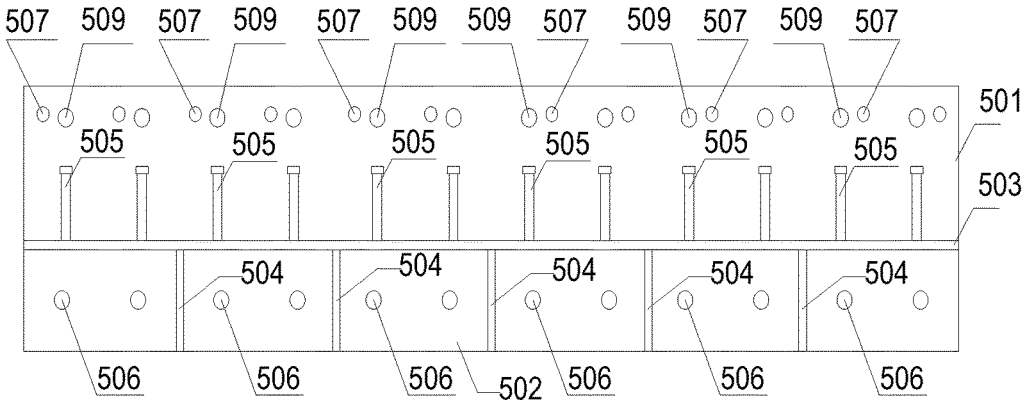
FIGURE 3-B

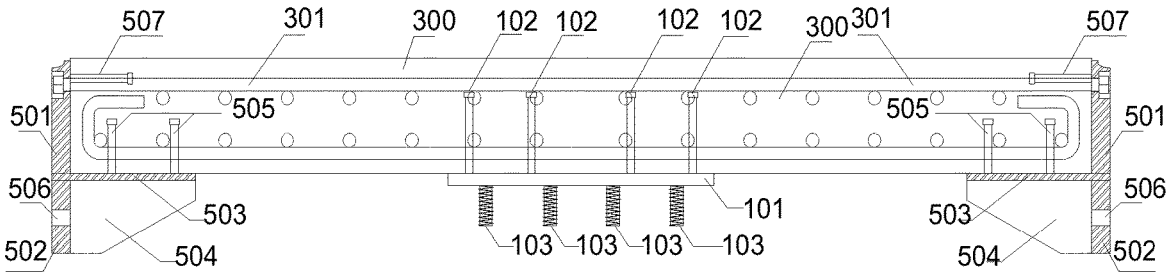
FIGURE 4
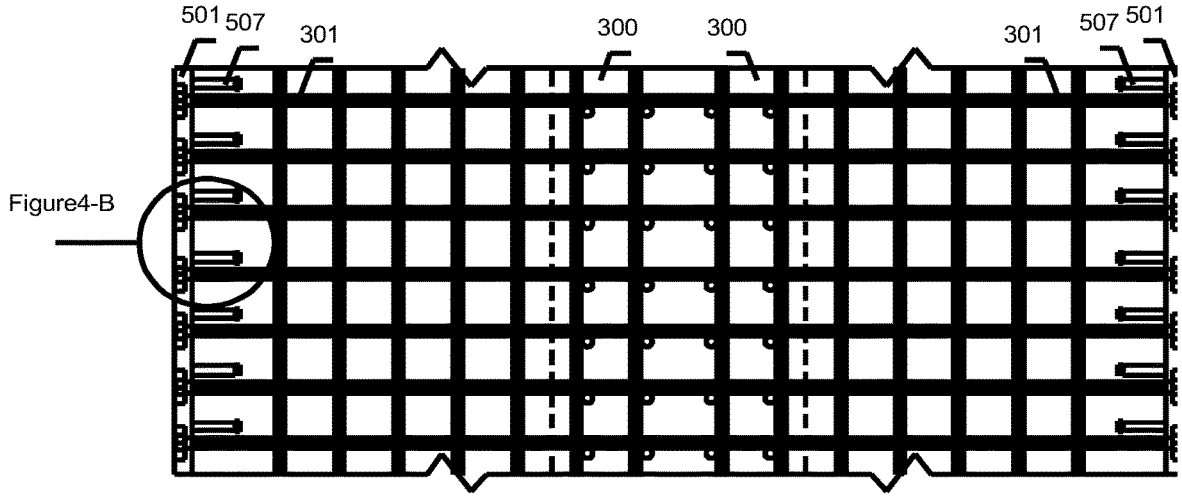
FIGURE 4-A
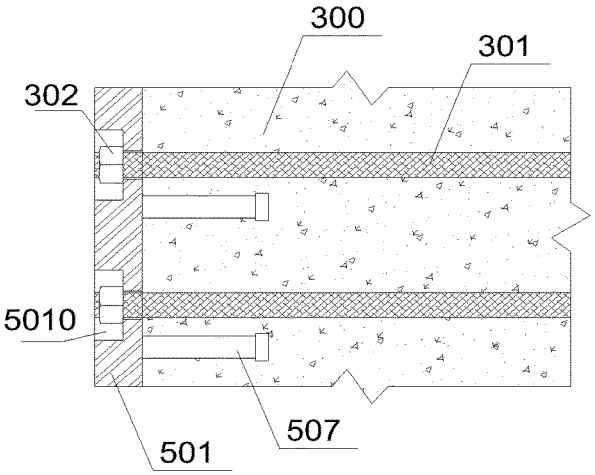
FIGURE 4-B

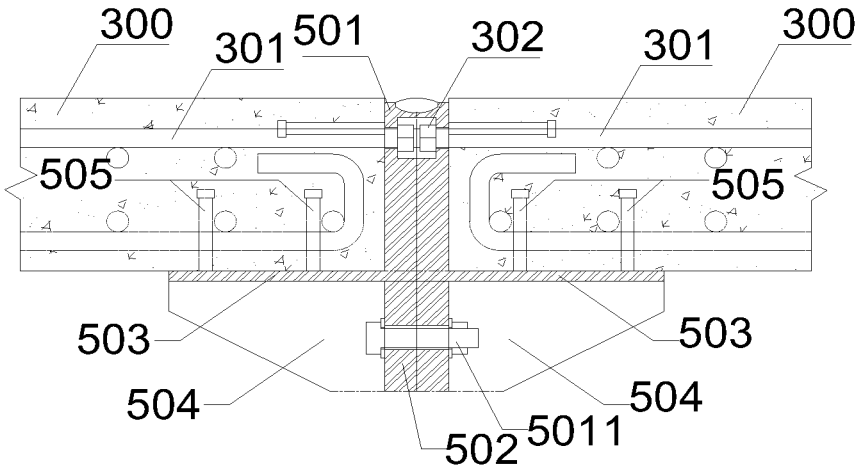
FIGURE 5-A

DRY CONNECTION PREFABRICATED ASSEMBLY STEEL-CONCRETE COMPOSITE BEAM

FIELD OF THE INVENTION

The present invention relates to steel-concrete composite beams, more specifically to prefabricated steel-concrete composite beam assemblies.

BACKGROUND OF THE INVENTION

Steel-concrete composite beam assemblies are a new structural type developed on the basis of a steel structure and a concrete structure. A shear connector is provided between the lower steel beam and the upper concrete flange slab (concrete slab) so as to resist any separation and/or relative slippage and/or displacement at the joint, thereby having the steel beam and concrete slab work together so as to form an intergrally functioning beam assembly. Existing connecting methods for steel beams and concrete slabs of a steel-concrete beam assembly is to weld one end of the shear connectors to the steel beam and pour concrete on the remaining parts to connect them with the concrete slab, and thereby unite the steel beam and the concrete slab on the construction site. Adjacent concrete slabs are wet connected by pouring concrete at the construction site. Large amounts of steel bar binding, connection and concrete pouring work are involved to connect steel beams to concrete slabs, and concrete slabs to concrete slabs, which usually consumes much construction time. In addition, pollution accompanying on-site concrete pouring and curing is unavoidable; furthermore, once steel beams are connected to the concrete slabs and concrete slabs to each other, it is impossible to separate them, rendering it difficult to use repeatedly.

SUMMARY OF THE INVENTION

The present invention aims to address deficiencies in the above-mentioned prior art, to provide a dry connection prefabricated assembled steel-concrete composite beam assembly which is capable of effectively reducing on-site construction work volume and environmental pollution, accelerating construction speed, and are detachable and reusable so as to improve prefabrication component levels in civil engineering and reduce construction and maintenance costs of the structure.

The technical solution of the present invention is a dry connection, a prefabricated assembled steel-concrete composite beam assembly which includes a steel beam, a concrete slab made of steel bars and concrete, a steel plate connector made from steel plates, shear connectors and connecting rods, wherein the assembly further includes a pair of concrete slab connectors respectively comprising an upper connection plate, a lower connection plate, a horizontal connection plate, a triangular stiffening steel plate, and first and second shear connectors. On the upper surface of the horizontal connection plate there is vertically connected the upper connection plate and the first shear connector, and upon its lower surface, the lower connection plate. A triangular stiffened steel plate is welded between the lower surface of the horizontal connection plate and one side of the lower connection plate, and the second shear connector is horizontally connected to one side of the upper connection plate.

Both ends of a transversely oriented steel bar has its ends embedded in the concrete slab and are equipped with threads such that the threaded ends pass through holes defined within upper portions of the upper connection plate of the two inter-slab connectors and are fixed with nuts thereon. Shear connectors on the steel plate connector are located centrally underneath a transversely embedded steel bar in the concrete slab, and the horizontally disposed steel plate is parallel to the horizontal connection plates in both of the inter-slab connectors. Concrete is then poured so as to embed the steel bar within the concrete slab, the first and second shear connectors of the inter-slab connectors and those in the steel plate connectors are also embedded within the concrete slab, so as to form the prefabricated steel-concrete composite beam assembly.

The prefabricated steel-concrete composite assembly is then connected to the steel beam via a plurality of connecting rods which extend vertically beneath the steel plate of the steel plate connector and are welded to the upper horizontal cross-beam of the I-shaped steel beam so as to form the steel-concrete composite beam unit, which is also known as a steel-concrete composite beam assembly.

Compared with the prior art, the beneficial effects of the invention are as follows:

The prefabricated steel-concrete assembly of the present invention can be made in a workshop. It is only necessary to connect the assembly with the steel beam, and neighboring assemblies at the construction site. Consequently, steel bar binding, concrete pouring, and curing work, necessary in the prior art and resulting in environmental pollution is effectively avoided, which greatly improves prefabricated assemblies of structures in bridge construction, and to a large extent expedites construction development. In the meantime as the composite beam adopts the prefabricated steel-concrete structural form, it is easy to disconnect the prefabricated steel-concrete assembly and the steel beam and replace any damaged components in case that the bridge structure needs repairs. In addition, where the bridge is to be dismantled, it is possible to keep the prefabricated steel-concrete assembly and the steel beam intact, reuse them, and thereby effectively reduce bridge maintenance and reconstruction costs. In addition, with the prefabricated composite beam assembly, the length and width of the concrete slabs and the steel plate connectors can be adjusted according to specific bridge conditions, which makes it applicable for maintenance and reconstruction of bridges of any dimension.

BRIEF DESCRIPTION OF THE DRAWINGS

FIG. 3 is a schematic structural view of a pair of inter-slab connectors of the present invention;

FIG. 3A is a cross-sectional view of FIG. 3 as taken along the lines I-I of FIG. 3;

FIG. 3B is a cross-sectional view of FIG. 3 as taken along the lines II-II of FIG. 3;

FIG. 4 is a schematic structural view of a prefabricated steel-concrete assembly;

FIG. 4A is a plan view of FIG. 4:

FIG. 4B is a partial enlarged view of the portion J in FIG. 4-A;

FIG. 5A is an enlarged view of the portion FIG. 5A in FIG. 5.

DETAILED DESCRIPTION OF THE ILLUSTRATED EMBODIMENT

Figure 1:
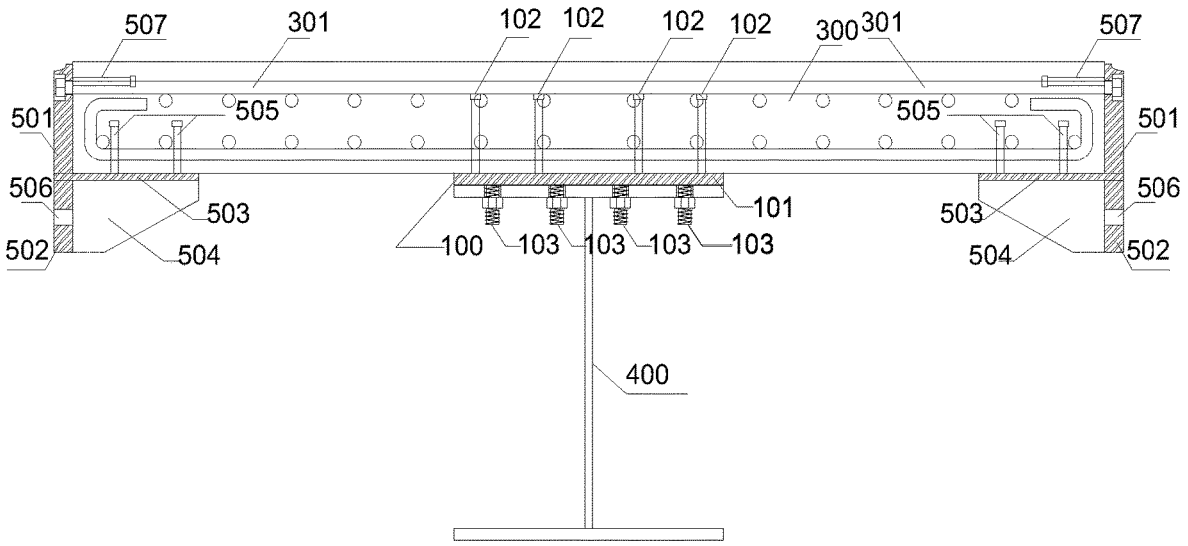
FIG. 1 is a schematic structural view of the present invention.
Figure 2:
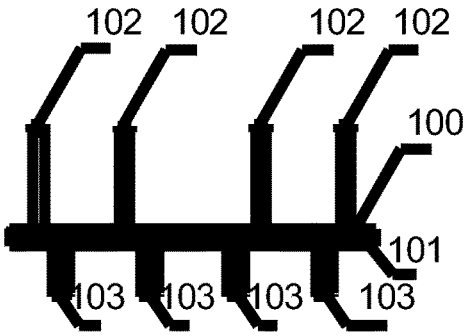
FIG. 2 is a schematic structural view of a steel plate connector of the present invention.

The dry connection of the present invention denotes a connection wherein the connection between a concrete member and a steel member or concrete members is achieved mechanically (such as by welding, bolts and nuts, mortise and tenon) to form an integral structure, which is contrary to the conventional "wet connection" made by concrete casting on site.

As is shown in FIG. 1-5, a dry connection prefabricated assembled steel-concrete composite beam comprises a steel beam having an I-shaped configuration; a concrete slab made of steel bars and concrete; and a steel plate connector assembly made of a steel plate, shear connectors, and connecting rods. Steel plate 101 in the steel plate connector assembly 100 (see FIG. 2) is horizontally disposed, a plurality of steel shear connectors 102 are vertically welded on the upper surface thereof, and a plurality of connection rods 103 are connected to the lower surface thereof. The dry connection prefabricated assembled steel-concrete composite beam further comprises a pair of inter-slab connectors respectively composed of an upper connection plate, a lower connection plate, a horizontal connection plate, a triangular stiffening steel plate, and first and second shear connectors (see FIG. 3). On the upper surface of the horizontal connection plate 503, a vertically oriented upper connection plate 501 is affixed, and on its lower surface, a vertically oriented lower connection plate 502 is affixed thereto. Between the lower surface of the horizontal connection plate 503 and a side of the lower connection plate 502 is welded a triangular stiffening steel plate 504, and on one side of the upper connection plate 501 is a plurality of horizontally oriented second shear connectors 507 are located.

Opposite ends of a horizontally oriented concrete steel reinforcing bar 301, which is embedded within the concrete slab 300, are respectively provided with threads, and both ends pass through bolt holes 509 and working holes 5010 disposed within the upper ends of the upper connection plates 501, which in turn are located near the plurality of second shear connectors 507, and are fixed with nuts 302 as best seen in FIG. 4-B. Shear connectors 102 of the steel plate connector 100 are centrally located beneath the horizontally embedded steel reinforcing bar 301 in the concrete slab 300, and the horizontally disposed steel plate 101 is disposed parallel to the horizontal connection plates 503 of the pair of inter-slab connectors. The first and second shear connectors 505,507 of the pair of inter-slab connectors and the shear connectors 102 of the steel plate connectors 100 are united with the concrete slab 300 when the concrete slab 300 is poured so as to form the prefabricated steel-concrete assembly, which reduces or even eliminates the tension stress among the concrete slab, the inter-slab connectors, and the steel plate connector 100 under load (see FIG. 4).

The prefabricated steel-concrete assembly is then adapted to be connected to the steel I-beam 400 by welding the connecting rods 103 of the steel plate connector 100 to the upper cross-beam of the steel I-beam 400 so as to form a steel-concrete composite beam unit, also called a steel-concrete composite beam.

Figure 5:
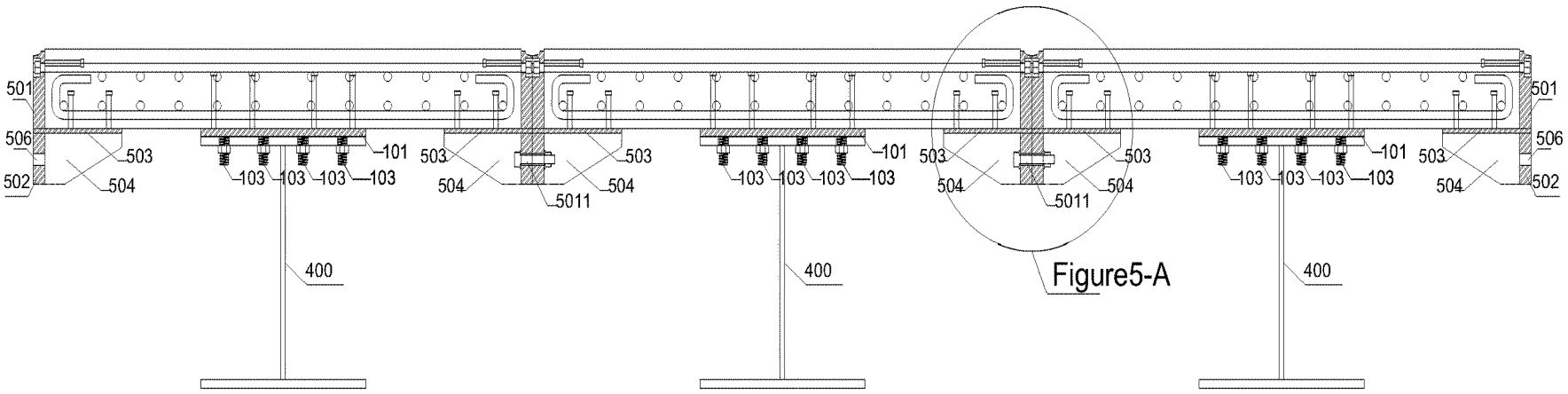
FIG. 5 is a schematic structural view of the connection of multiple steel-concrete composite beam systems together.

External sides 508 of each inter-slab connector of neighboring steel-concrete composite beams can be joined together as shown within FIG. 5. Upper ends of the external sides 508 of the inter-slab connectors are connected together by welding, or mortise and tenon structures, while the lower ends of the external sides 508 of the inter-slab connectors are connected together by high strength bolts 5011 that go through bolt holes 506 located on the lower connection plates 502 of the inter-slab connectors, so as to render the steel-concrete composite beam connection to be an integral working steel-concrete composite beam system strong enough to withstand axial forces, bending moments, and shear forces.

The connection rods 103 of the steel plate connector 100 may comprise any round steel rods, threaded rods, or rivets. Connections of the connection rods to the steel plate 101 may be by welding where the connection rods are steel round rods or rivets, and by threaded connections where the connection rods are threaded rods. Connection methods between the connection rods 103 and the steel beam 400 may be bolting where the connection rods 103 are threaded rods, welding where the connection rods 103 are steel round rods, and riveting where the connection rods 103 are rivets.

The concrete used in the prefabricated concrete slab 300 may be conventional concrete, fiber concrete, reactive powder concrete, or coarse aggregate containing reactive powder concrete.

The invention claimed is:

1. A prefabricated steel-concrete composite beam assembly, comprising:

a steel beam having an I-shaped configuration;

a concrete slab comprising a steel reinforcing bar and concrete;

a steel plate connector comprising a horizontally oriented steel plate, a plurality of shear connectors, and a plurality of connection rods; and a pair of inter-slab connectors comprising a pair of oppositely disposed, vertically oriented upper connection plates, a pair of oppositely disposed vertically oriented lower connection plates, a pair of oppositely disposed horizontally oriented connection plates, a pair of oppositely disposed triangular stiffening steel plates, and a pair of oppositely disposed first shear connectors, and a pair of oppositely disposed second shear connectors;

wherein said pair of vertically oriented upper connection plates and said pair of first shear connectors are connected to upper surface portions of said pair of horizontally oriented connection plates, with said first shear connectors being adapted to be embedded within said concrete slab, said pair of oppositely disposed vertically oriented lower connection plates are connected to undersurface portions of said pair of horizontally oriented connection plates, said pair of triangular stiffened steel plates are welded to said undersurface portions of said pair of oppositely disposed horizontally oriented connection plates and side surface portions of said pair of vertically oriented lower connection plates, said pair of oppositely disposed second shear connectors are fixedly connected to upper end portions of said pair of vertically oriented upper connection plates and are also adapted to be embedded within said concrete slab, a transversely oriented steel reinforcing bar is also embedded within said concrete slab and has oppositely disposed threaded ends which pass through first bolt holes defined within upper end portions of said pair of oppositely disposed upper connection plates so as to be fixedly secured by nuts which are accommodated within second nut holes which are coaxially defined with respect to said first bolt holes within said upper end portions of said pair of oppositely disposed upper connection plates; and wherein said steel plate of said steel plate connector, and said plurality of shear connectors connected to said steel plate connector are all embedded within a lower central portion of said concrete slab so as to form said prefabricated steel-concrete composite beam assembly, said horizontally disposed steel plate is disposed parallel to said pair of oppositely disposed horizontally oriented connection plates, and said plurality of connection rods of said steel plate connector are welded to a horizontally oriented portion of said steel beam having said 1-shaped configuration so as to complete said prefabricated steel-concrete composite beam assembly.

2. The prefabricated steel-concrete composite beam assembly of claim 1, wherein:

an external side surface of the inter-slab connector can be joined with an external surface of an adjacent inter-slab connector so as to form an integral prefabricated steel-concrete composite beam assembly system by welding upper end portions of said pair of external side surfaces together, while lower end portions of said external side surfaces are connected together by high strength bolts and fasteners.

3. The prefabricated steel-concrete composite beam assembly of claim 1, wherein:

said concrete slab is fabricated from concrete selected from the group comprising concrete, fiber concrete, reactive powder concrete, and coarse aggregate containing reactive powder concrete.

4. The prefabricated steel-concrete composite beam assembly of claim 1, wherein:

said plurality of connection rods of said steel plate connector are selected from the group comprising steel round rods, threaded rods, and rivets.

5. The prefabricated steel-concrete composite beam assembly of claim 1, wherein;

said plurality of connection rods of said steel plate connector are connected to said steel plate by welding and wherein said plurality of connection rods are selected from the group comprising round steel rods and rivets.

6. The prefabricated steel-concrete composite beam assembly of claim 1, wherein:

said plurality of first and second shear connectors are selected from the group comprising a shear peg, a perforated plate shear connector, a section steel shear connector, and a steel bar shear connector.

7. The prefabricated steel-concrete composite beam assembly of claim 1, wherein:

said plurality of connection rods of said steel plate connector are connected to said steel plate by threaded connections wherein said plurality of connection rods of said steel plate connector are threaded rods.

* * * * *